US006971908B2

(12) United States Patent
Shiu et al.

(10) Patent No.: US 6,971,908 B2
(45) Date of Patent: Dec. 6, 2005

(54) ZERO INSERTION FORCE ELECTRICAL CONNECTOR

(75) Inventors: Guo Jiun Shiu, Tu-Chen (TW); Kun Hua Chen, Tu-Chen (TW); Sadao Watanabe, Furukawa (JP)

(73) Assignee: Hon Hai Precision Ind. Co., Ltd., Taipei Hsien (TW)

( * ) Notice: Subject to any disclaimer, the term of this patent is extended or adjusted under 35 U.S.C. 154(b) by 0 days.

(21) Appl. No.: 10/880,191

(22) Filed: Jun. 28, 2004

(65) Prior Publication Data

US 2004/0266242 A1 Dec. 30, 2004

(30) Foreign Application Priority Data

Jun. 27, 2003 (TW) ..... 92211778 U

(51) Int. Cl.[7] ..... H01R 12/24
(52) U.S. Cl. ..... 439/495; 439/260
(58) Field of Search ..... 439/495, 260

(56) References Cited

U.S. PATENT DOCUMENTS 5,458,506 A * 10/1995 Yamaguchi et al. ..... 439/495
5,695,360 A * 12/1997 Seto et al. ..... 439/495
5,785,549 A 7/1998 Takayasu
5,839,917 A * 11/1998 Takahashi et al. ..... 439/495
5,842,883 A * 12/1998 Igarashi et al. ..... 439/495
5,895,287 A 4/1999 Seto et al.
5,904,586 A * 5/1999 Takayasu ..... 439/260
6,099,346 A * 8/2000 Hashiguchi et al. ..... 439/495
6,171,137 B1 * 1/2001 Hatakeyama ..... 439/495
6,383,017 B1 * 5/2002 Takayasu ..... 439/495
6,767,233 B2 * 7/2004 Tsunematsu ..... 439/260
6,790,074 B1 * 9/2004 Chiu ..... 439/495

* cited by examiner

*Primary Examiner*—Ross Gushi
(74) *Attorney, Agent, or Firm*—Wei Te Chung

(57) ABSTRACT

An electrical connector (1) includes an insulative housing (2) for receiving a sheet-like connection member, a plurality of electrical contacts (4) received in the housing, and an operation member (3) mounted onto the housing. The housing has a lower wall (24) and an upper wall (22) opposite to the lower wall. The upper wall forms a plurality of second ribs on a bottom thereof. Each second rib forms a curved end (226) exposed outwardly from an edge (222) of the upper wall. The operation member forms an elongate pressing portion (324) at a bottom thereof, and a channel (322) defined in a main face thereof opposite from the pressing portion. The operation member is rotatable from an open position to a closed position, with the channel pivoting about the curved ends of the first ribs of the housing, thereby pressing the connection member upon the contact arms of the contacts.

19 Claims, 6 Drawing Sheets

ZERO INSERTION FORCE ELECTRICAL CONNECTOR

BACKGROUND OF THE INVENTION

1. Field of the Invention

The present invention relates to a zero insertion force electrical connector, which provides electrical connection between a sheet-like connection member such as a flexible printed circuit (FPC) or a flat cable with a circuit substrate such as a printed circuit board (PCB).

2. Description of the Prior Art

Zero insertion force (ZIF) electrical connectors are widely used for electrically connecting sheet-like connection members such as flexible printed circuits (FPCs) or flat cables with circuit substrates such as printed circuit boards (PCBs). Such ZIF connectors are disclosed in U.S. Pat. Nos. 5,695,360, 5,785,549, 5,842,883 and 5,895,287.

FIG. 8 shows a cut-away view of a conventional ZIF connector 9. The ZIF connector 9 comprises an insulative housing 8, a plurality of electrical contacts 6 received in the housing 8, and a rotatable pressuring member 7 mounted on the housing 8. The housing 8 comprises a lower wall 81, an upper wall 82 opposite to the lower wall 81, and a pair of lateral sidewalls each interconnecting the lower wall 81 and the upper wall 82. A front opening is defined in a front side of the housing 8, and a rear opening is defined in a rear side of the housing 8. The lower wall 81 defines a multiplicity of chambers 811 therein. The upper wall 82 defines a multiplicity of slots 822 therein. The contacts 6 are received in the housing 8 from the rear opening thereof. Each contact 6 comprises a base portion 61, a tail 66 depending from an end of the base portion 61 and disposed outside the housing 8 for electrically connecting with a PCB (not shown), and a securing arm 62 and a contact arm 64 bifurcated from an opposite end of the base portion 61. The securing arm 62 is engagingly received in a corresponding slot 822 of the upper wall 82, and forms a pivoting portion 621 at a free end thereof. The contact arm 64 is received in a corresponding chamber 811 of the lower wall 81, and forms a contact portion 641 at a free end thereof. The pressuring member 7 pivotably engages with the pivoting portions 621 of the contacts 6.

In use, the pressuring member 7 is first oriented at an open, vertical position. An end of a sheet-like connection member (not shown), such as an FPC or a flat cable, is inserted into the front opening of the housing 8 with zero insertion force. The end of the connection member is located between the pressuring member 7 and the contact portions 641 of the contacts 6, and loosely contacts the contact portions 641. The pressuring member 7 is rotated down to a horizontal position, pivoting about the pivoting portions 621 of the contacts 6. A bottom of the pressuring member 7 presses the end of the connection member onto the contact portions 641 of the contacts 6. The connection member is thus electrically connected with the PCB by the ZIF connector 9.

During the above-mentioned operation, the pressuring member 7 exerts forces on the pivoting portions 621 of the contacts 6. Such pressure is liable to deform the securing arms 62 of the contacts 6 and/or displace the contacts 6 out through the rear opening of the housing 8. When this happens, the ZIF connector 9 cannot provide reliable electrical connection between the connection member and the PCB.

In view of the above, a new electrical connector that overcome above-mentioned disadvantages is desired.

SUMMARY OF THE INVENTION

Accordingly, a main object of the present invention is to provide a zero insertion force (ZIF) electrical connector for electrically connecting a sheet-like connection member such as a flexible printed circuit (FPC) or a flat cable with a circuit substrate such as a printed circuit board (PCB), and particularly to provide a ZIF connector that has a plurality of electrical contacts reliably received therein.

Another object of the present invention is to provide a ZIF connector, wherein when a connection member is inserted into the ZIF connector, a pressuring member of the ZIF connector is locked at a horizontal position to reliably electrically connect the connection member with a PCB.

To achieve the above objects, a zero insertion force (ZIF) electrical connector in accordance with a preferred embodiment of the present invention comprises an insulative housing for receiving a sheet-like connection member, a plurality of electrical contacts received in the housing, a rotatable operation member mounted on the housing, and a pair of positioning members mounted on two opposite ends of the housing for assisting in mounting the connector onto a PCB. The housing has a lower wall and an upper wall opposite to the lower wall. The upper wall forms a plurality of second ribs on a bottom thereof, every two adjacent second ribs defining a first passageway therebetween. Each second rib forms a curved end exposed outwardly from an edge of the upper wall. Each contact comprises a securing arm and a contact arm bifurcated from the securing arm, the securing arm received in a corresponding passageway of the housing. The operation member forms an elongate pressing portion at a bottom thereof, and a channel defined in a main surface thereof opposite from the pressing portion. The operation member is rotatable from an open position where a sheet-like connection member is admitted into the housing to a closed position where the pressing portion presses the connection member against the contact arms of the contacts, with the channel pivoting the curved ends of the first ribs of the housing.

Other objects, advantages and novel features of the invention will become more apparent from the following detailed description when taken in conjunction with the accompanying drawings.

DETAILED DESCRIPTION OF THE PREFERRED EMBODIMENT OF THE INVENTION

Reference will now be made to the drawings to describe the present invention in detail.

Figure 1:
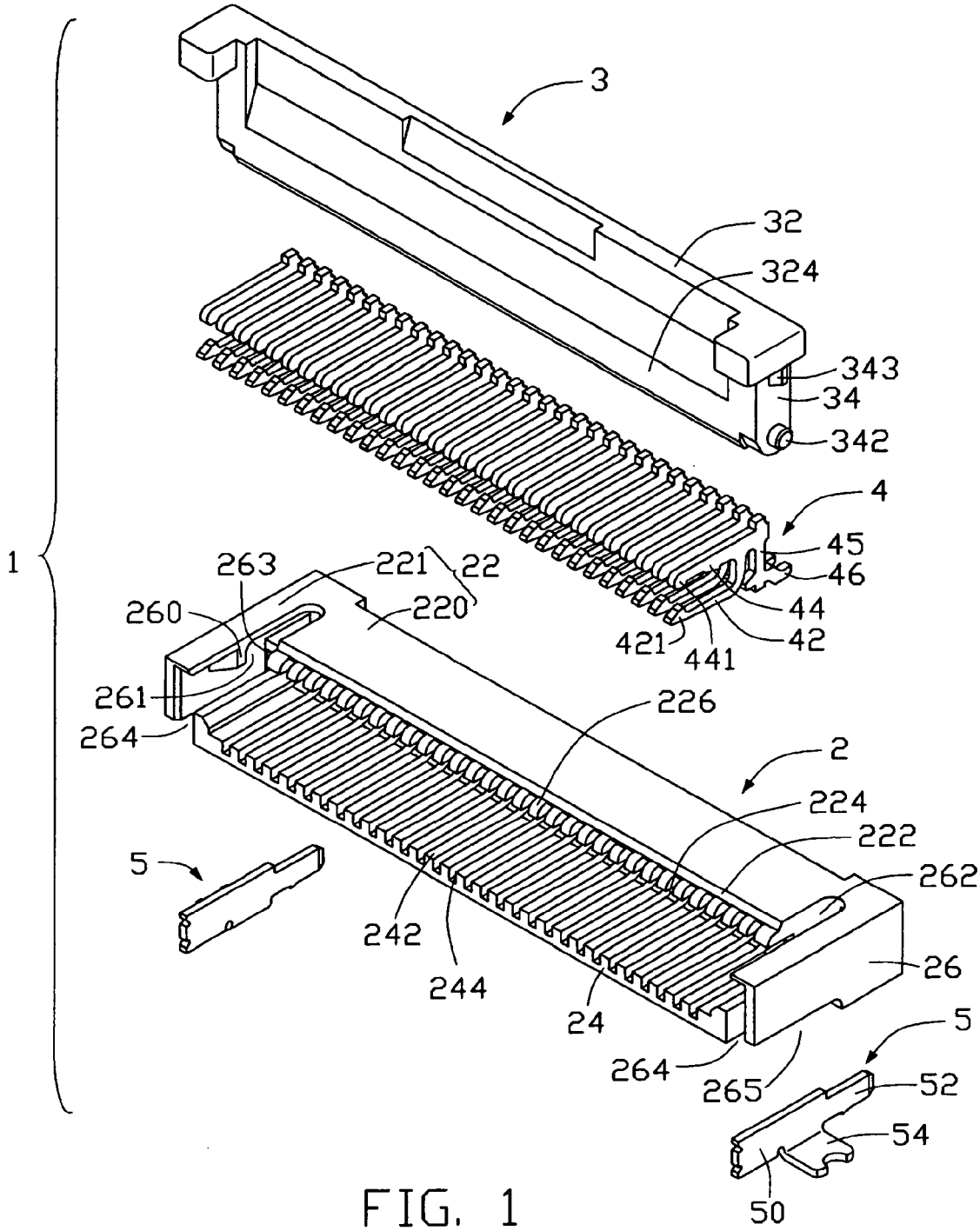
FIG. 1 is an exploded, isometric view of a zero insertion force (ZIF) electrical connector in accordance with the preferred embodiment of the present invention.

FIG. 1 is an exploded, isometric view of a zero insertion force (ZIF) electrical connector 1 of the preferred embodiment of the present invention. The connector 1 provides electrical connection between a sheet-like connection member (not shown) such as a flexible circuit board (PCB) or a flat cable with a circuit substrate such as a printed circuit board (PCB) (not shown). The connector 1 comprises an insulative housing 2, a plurality of electrical contacts 4 received in the housing 2, a rotatable operation member 3 mounted on the housing 2, and a pair of positioning members 5 mounted on two opposite ends of the housing 2 respectively.

The housing 2 comprises a lower wall 24, a pair of lateral sidewalls 26 respectively extending from two opposite ends of the lower wall 24, and an upper wall 22 interconnecting the sidewalls 26. The lower wall 24 forms a multiplicity of spaced first ribs 242, every two adjacent first ribs 242 defining a first passageway 244 therebetween. The upper wall 22 has a substantially U-shaped profile, comprising an elongate portion 220 and a pair of end portions 221 at two opposite ends of the elongate portion 220. The elongate portion 220 forms a multiplicity of spaced second ribs (not labeled) on a bottom thereof, every two adjacent second ribs defining a second passageway 224 therebetween. Each second rib has a curved end 226, the curved end 226 exposed outwardly from an edge 222 of the elongate portion 220. Also referring to FIG. 7, a chamber 262 is defined between each of the end portions 221 and the elongate portion 220. A projecting portion 260 extends perpendicularly from an inner side of each sidewall 26 under the end portion 221 of the upper wall 22, the projecting portion 260 defining a curved recess 261 therein. Each sidewall 26 defines a gap 265 at a bottom edge thereof. A receiving groove 264 is defined between each of two opposite ends of the lower wall 24 and each respective sidewall 26. A generally rectangular receiving hole 263 is defined in a rear portion of each of the two opposite ends of the lower wall 24, the receiving hole 263 being in communication with a respective receiving groove 264.

Each contact 4 comprises a body portion 45, a tail 46 extending from an end of the body portion 45, and a securing arm 44 and a contact arm 42 bifurcated from an opposite end of the body portion 45. The securing arm 44 comprises several bottom protrusions 440 (see FIG. 4), and a pivoting portion 441 at a free end thereof. The contact arm 42 forms a contact portion 421 at a free end thereof. The contacts 4 are inserted into the housing 2 from a rear side thereof. The securing arm 44 of each contact 4 is engagingly received in a corresponding second passageway 224 of the housing 2, with the protrusions 440 interferentially engaging in the second passageway 224. Center axes of the pivoting portions 441 of the contacts 4 and center axes of the curved ends 226 of the housing 2 are coaxial. A diameter of each curved end 226 is greater than a diameter of each pivoting portion 441. The contact arm 42 of each contact 4 is received in a corresponding first passageway 244 of the housing 2. The tails 46 of the contacts 4 are disposed outside the rear of the housing 2 uniformly. A plane defined by the tails 46 is parallel to the bottom wall 24 of the housing 2, for electrical connection of the tails 46 with the PCB.

Figure 2:
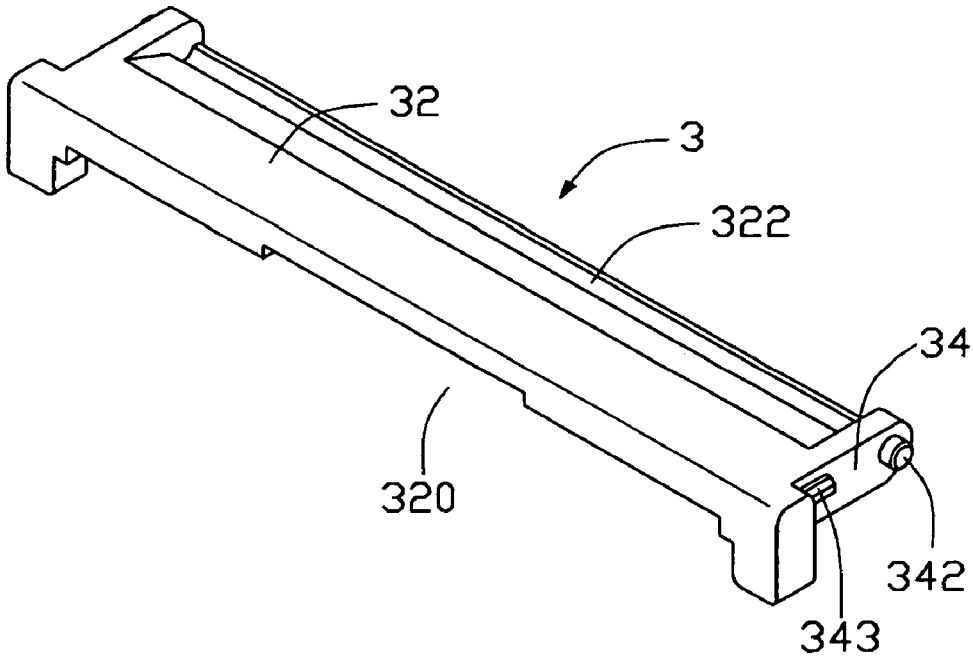
FIG. 2 is an isometric view of an operation member of the connector of FIG. 1, but viewed from another aspect.

Also referring to FIG. 2, the operation member 3 comprises an elongate actuation portion 32, and a pair of latches 34 formed at two opposite ends of the actuation portion 32 respectively. The actuation portion 32 defines an elongate receiving opening 320 generally between the latches 34, and forms an elongate pressing portion 324 adjacent the receiving opening 320. An elongate channel 322 is defined in a main face of the actuation portion 32 opposite from the pressing portion 324, for pivotably receiving the curved ends 226 of the housing 2 therein. A pivot 342 is formed on each latch 34, for engaging in a corresponding curved recess 261 of the housing 2. A wedge 343 is formed on each latch 34.

The positioning members 5 are each made of metallic material. Each positioning member 5 comprises a base portion 50, a narrowed portion 52 extending from an end of the base portion 50, and a solder portion 54 extending perpendicularly from a bottom edge of the base portion 50.

Figure 3:
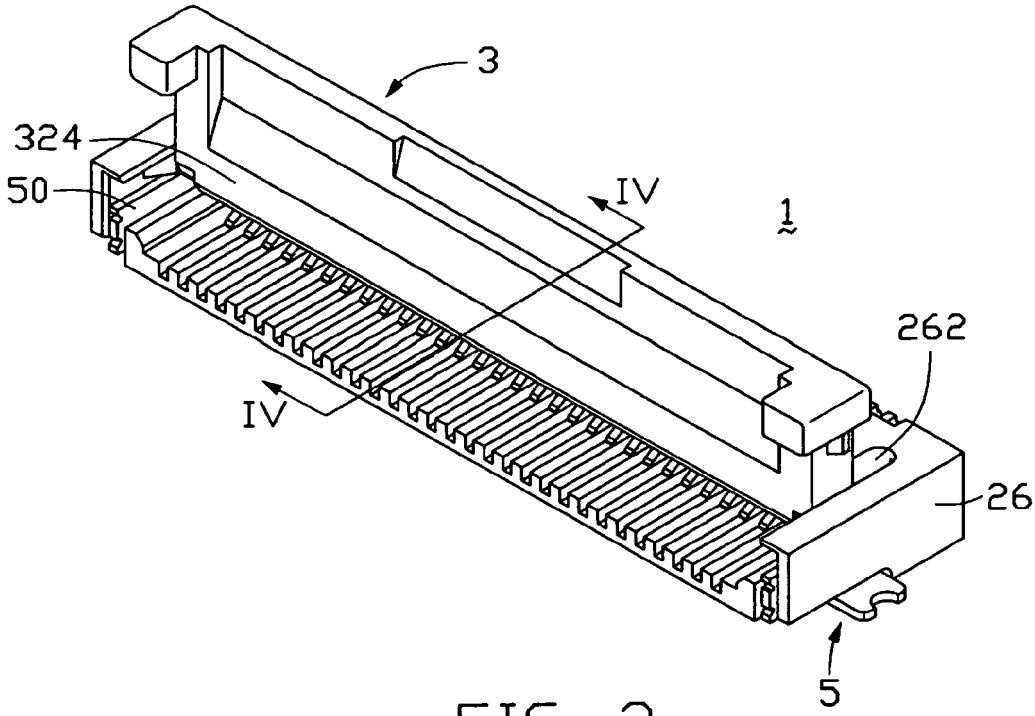
FIG. 3 is an assembled view of FIG. 1, showing the operation member at an open position.
Figure 4:
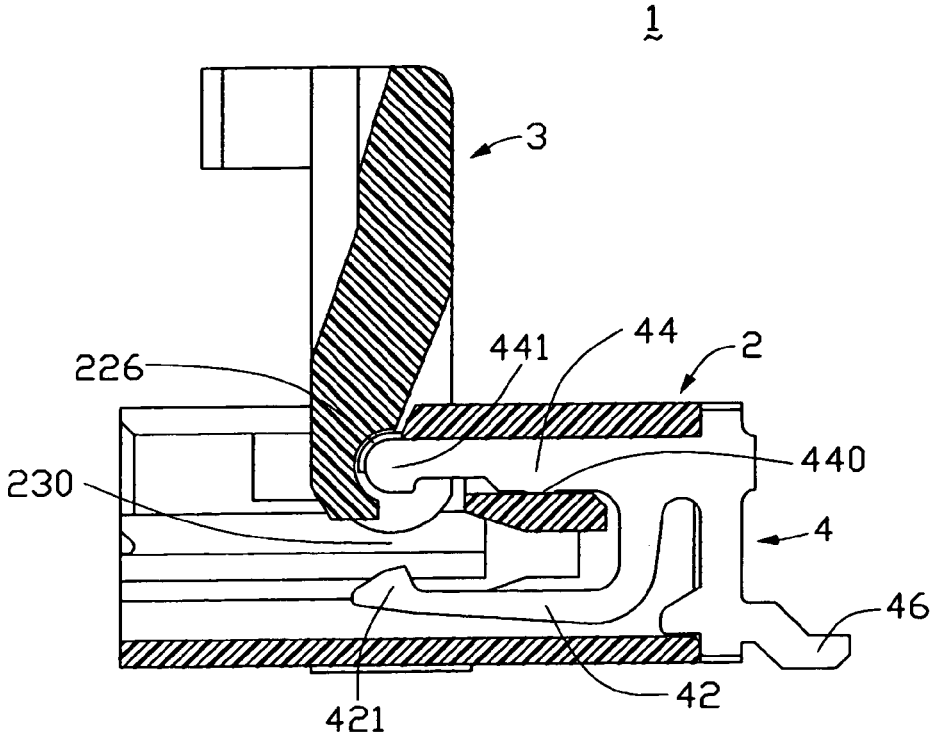
FIG. 4 is an enlarged, cross-sectional view taken along line IV—IV of FIG. 3.
Figure 5:
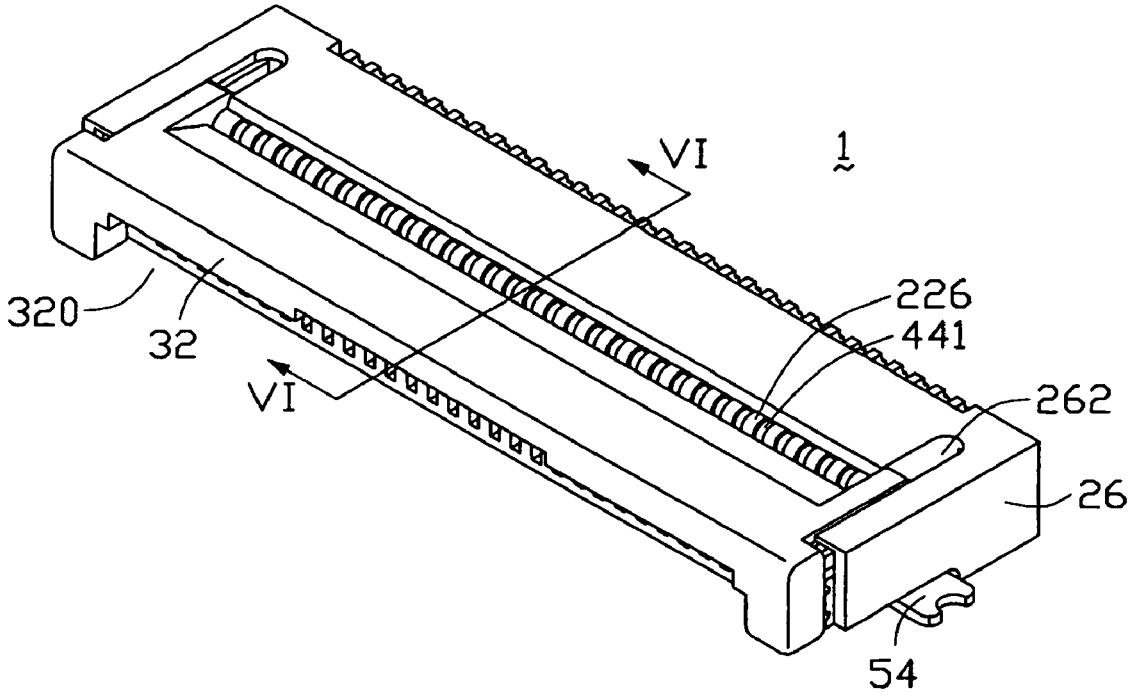
FIG. 5 is similar to FIG. 3, but showing the operation member at a closed position.
Figure 7:
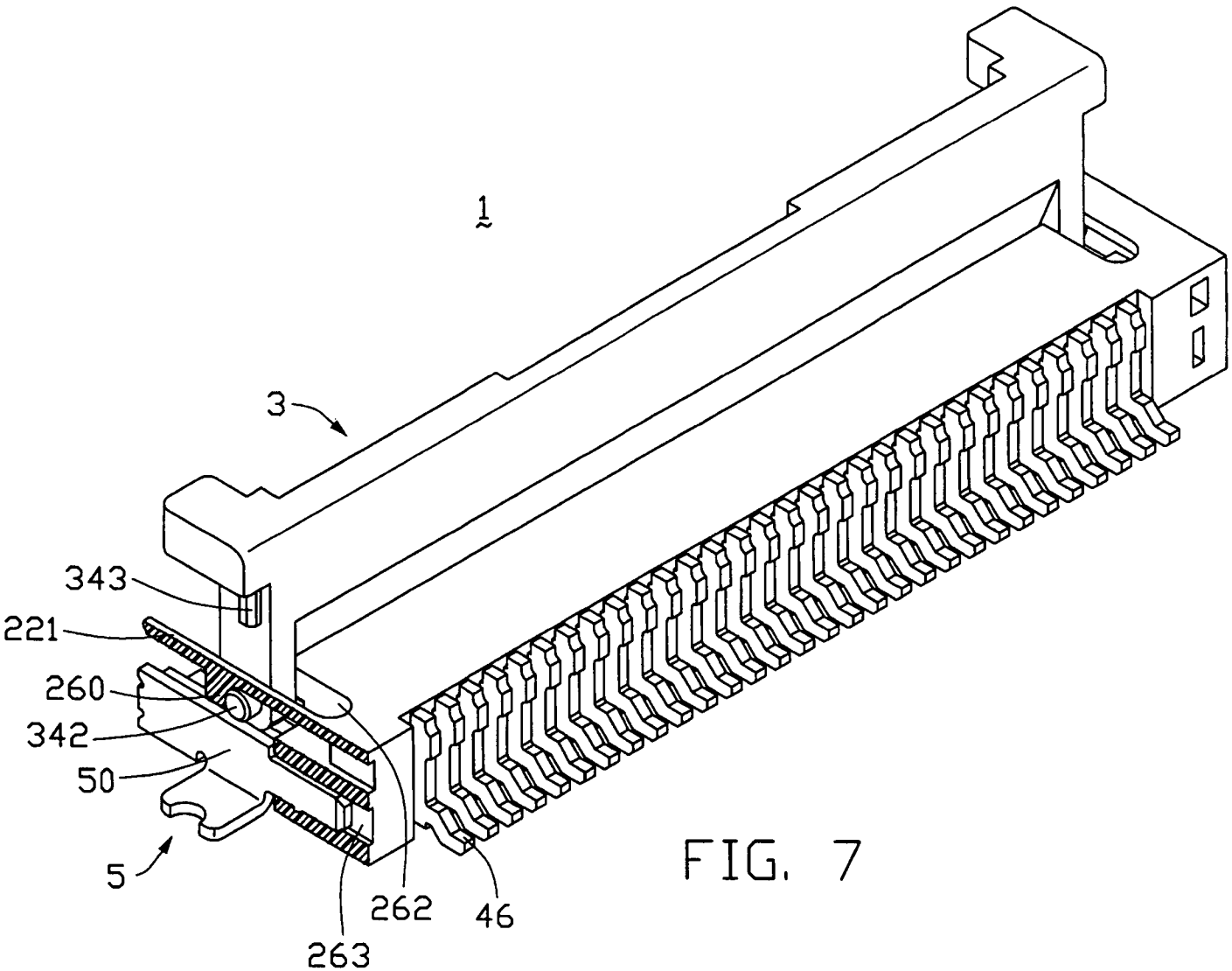
FIG. 7 is similar to FIG. 3, but viewed from another aspect and having part of a housing thereof cut away.
Figure 8:
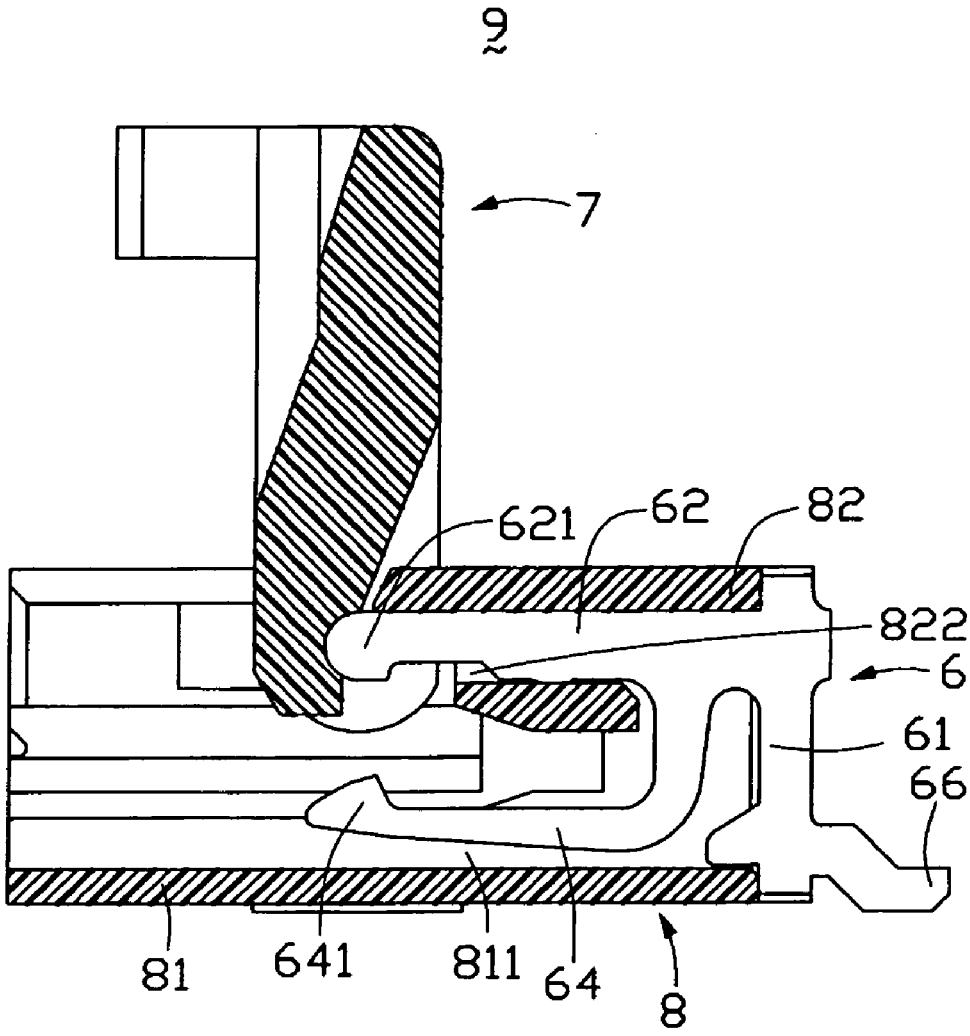
FIG. 8 (PRIOR ART)
FIG. 8 is a schematic, cross-sectional view of a conventional ZIF connector.

Referring also to FIGS. 3, 4 and 7, in assembly, the operation member 3 is inserted into a front side of the housing 2, with the actuation portion 32 parallel to the lower wall 24 of the housing. The pivots 342 slide into the corresponding curved recesses 261 of the housing 2 via bottoms of the projecting portions 260, and the latches 34 are received in the chambers 262. A receiving cavity 230 is defined generally between the contact arms 42 of the contacts 4 and an end edge section of the pressing portion 324 of the operation member 3 (see FIG. 4). Then, the operation member 3 is rotated up. The curved ends 226 of the housing 2 pivotably engage with the operation member 3 in the channel 322. The positioning members 5 are inserted into the housing 2, with the narrowed portions 52 interferentially received in the receiving holes 263, and the base portions 50 received in the receiving grooves 264. Each end portion 221, the corresponding projecting portion 260 and a top edge of the corresponding positioning member 5 cooperatively retain the corresponding pivot 342 in the corresponding curved recess 261. The solder portions 54 of the positioning members 5 pass through the gaps 265 of the housing 2, and protrude outwardly from the sidewalls 26. The solder portions 54 are welded onto desired portions of the PCB, for facilitating mounting of the connector 1 onto the PCB.

Figure 6:
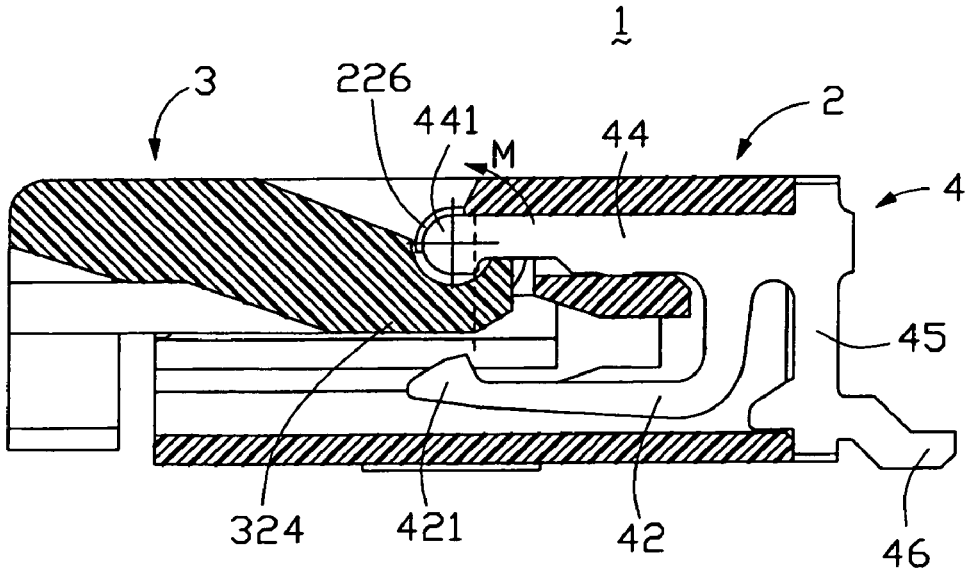
FIG. 6 is an enlarged, cross-sectional view taken along line VI—VI of FIG. 5.

Referring to FIGS. 3 through 6, in use, the operation member 3 is oriented at an open position perpendicular to the housing 2. An end of the connection member (not shown) is inserted into the receiving cavity 230 of the connector 1 with zero insertion force. The operation member 3 is rotated downwardly, with the pivots 342 pivoting in the curved recesses 261 of the housing 2, and the channel 322 pivoting about the curved ends 226 of the housing 2. When the operation member 3 reaches a closed position parallel to the housing 2, the connection member is disposed in the receiving opening 320 of the operation member 3. An end of the pressing portion 324 abuts against undersides of the securing arms 44 of the contacts 4. The end of the pressing portion 324 blocks the pivoting portions 441 from being displaced out from the housing 2. A main face of the pressing portion 324 presses the connection member upon the contact portions 421 of the contacts 4. The wedges 343 engage with undersides of the end portions 221 adjacent the projecting portions 260. Additionally, as can be seen in FIG. 6, the contact portions 421 exert resilient upward forces on the pressing portion 324 via the connection member (not shown). These forces provide moment M acting on the operation member 3, which facilitates the operation member 3 rotating toward the closed position. Thus, the operation member 3 is locked at the closed position, and provides reliable electrical connection between the connection member and the PCB.

During the above-mentioned operation, the operation member 3 does not exert forces upon the pivoting portions 441 of the contacts 4. Therefore the securing arms 44 of the contacts 4 are not subjected to deformation, and the contacts 4 are not prone to be displaced out from the housing 2.

While a preferred embodiment in accordance with the present invention has been shown and described, equivalent modifications and changes known to persons skilled in the art according to the spirit of the present invention are considered within the scope of the present invention as defined in the appended claims.

What is claimed is:

1. An electrical connector comprising:

an insulative housing for receiving a sheet-like connection member, the insulative housing having a lower wall and an upper wall, the upper wall forming a plurality of first ribs at a bottom thereof, every two adjacent first rib defining a first passageway therebetween, each first rib forming a curved end exposed outwardly from an edge of the upper wall;

a plurality of electrical contacts received in the housing, each contact comprising a securing arm and a contact arm bifurcated from the securing arm, the securing arm being received in a corresponding passageway;

an operation member pivotably engaging the housing, the operation member having a pressing portion at a bottom thereof and a channel in a portion thereof opposite from the pressing portion, the operation member being rotatable with pivoting about the curved ends of the first ribs of the housing from an open position where the connection member is admitted into the housing to a closed portion where the pressing portion presses the connection member against the contact arms of the contacts.

2. The electrical connector as claimed in claim 1, further comprising a pair of positioning members mounted on two opposite ends of the housing.

3. The electrical connector as claimed in claim 1, wherein a plurality of second ribs is defined in the lower wall of the housing, every two adjacent second ribs defining a second passageway therebetween for receiving the contact arm of a corresponding contact.

4. The electrical connector as claimed in claim 1, wherein a contact portion is formed at a free end of the contact arm of each of the contact.

5. The electrical connector as claimed in claim 4, wherein when the pressing portion of the operation member presses the connection member against the contact portions of the contacts, the contact portions exert resilient forces on the operation member to provide a moment facilitating the operation member to rotate toward the closed position.

6. The electrical connector as claimed in claim 1, wherein the upper wall of the housing has a substantially U-shaped profile and comprises an elongate portion and a pair of end portions at two opposite ends of the elongate portion.

7. The electrical connector as claimed in claim 6, wherein a chamber is defined between each of the pair of end portions and the elongate portion.

8. The electrical connector as claimed in claim 7, wherein a projecting portion extends from an inner side of each sidewall of the housing under the end portion of the upper wall, the projecting portion defining a curved recess therein.

9. The electrical connector as claimed in claim 8, wherein the operation member comprises an actuation portion and a pair of latches formed at the two opposite ends of the elongate portion.

10. The electrical connector as claimed in claim 9, wherein a pivot is formed on each latch, the pivot being pivotably received in a corresponding recess of the housing.

11. The electrical connector as claimed in claim 10, wherein a wedge is formed on each latch, the wedge engaging with underside of the end portion of the upper wall adjacent the projecting portion when the operation member is at the closed position.

12. An electrical connector comprising:

an insulative housing for receiving a flexible printed circuit board, the insulative housing having opposite first and second walls;

a plurality of electrical contacts received in the housing, each contact comprising opposite securing arm and contact arm, the securing arm located around the first wall and the contact arm located round the second wall;

an operation member pivotable relative to the housing, the operation member having a pressing portion at a bottom thereof the operation member being rotatable about the curved portions formed on the first wall from an open position where the flexible printed circuit board is admitted into the housing to a closed position where the pressing portion press the flexible printed circuit board against the contact arms of the contacts; wherin contact points of the contact arms urge the operation member to the closed position.

13. The electrical connector as claimed in claim 12, wherein said operation member is pivotably assembled to the housing.

14. The electrical connector as claimed in claim 12, wherein a pair of positioning members mounted on two opposite ends of the housing.

15. The electrical connector as claimed in claim 12, wherein the first wall of the housing has a substantially U-shaped profile and comprises an elongate portion and a pair of end portions at two opposite ends of the elongate portion.

16. The electrical connector as claimed in claim 15, wherein a chamber is defined between each of the pair of end portions and the elongate portion.

17. The electrical connector as claimed in claim 12, wherein a projecting portion extends from an inner side of each sidewall of the housing under the end portion of the upper wall, the projecting portion defining a curved recess therein.

18. The electrical connector as claimed in claim 17, wherein the operation member comprises an actuation portion and a pair of latches formed at the two opposite ends of the elongate portion.

19. The electrical connector as claimed in claim 18, wherein a wedge is formed on each latch, the wedge engaging with underside of the end portion of the upper wall adjacent the projecting portion when the operation member is at the closed position.

* * * * *